United States Patent [19]

Hipp

[11] Patent Number: 4,702,325

[45] Date of Patent: Oct. 27, 1987

[54] APPARATUS AND METHOD FOR DRIVING CASING OR CONDUCTOR PIPE

[75] Inventor: James Hipp, 110 Leitmeyer, New Iberia, La. 70560

[73] Assignee: James Hipp, New Iberia, La.

[21] Appl. No.: 657,970

[22] Filed: Oct. 4, 1984

[51] Int. Cl.[4] ..... B25D 17/14

[52] U.S. Cl. ..... 173/64; 173/61; 175/215; 175/257

[58] Field of Search ..... 173/73, 61, 62, 63, 173/64, 132; 175/77, 78, 215, 257

[56] References Cited

U.S. PATENT DOCUMENTS 3,847,230 11/1974 Blomquist ..... 405/232 X 3,871,486 3/1975 Curington et al. ..... 175/215 X

*Primary Examiner*—E. R. Kazenske

*Assistant Examiner*—Willmon Fridie, Jr.

*Attorney, Agent, or Firm*—Bernard A. Reiter; Mark G. Bocchetti

[57] ABSTRACT

Apparatus for driving casing, piles, or conductor pipe into the ground comprises in combination; an external reciprocal impact driving means supported atop the conductor pipe, internal rotatable drilling means supported within the conductor pipe, and means associated therewith for introducing air and water under pressure for creating a pressure differential to evacuate the drilling debris and cuttings to the surface. The drilling means is supported within said conductor pipe at the bottom portion thereof near the point of least energy absorption and rebound. The driving and drilling operations may be performed simultaneously or sequentially.

17 Claims, 8 Drawing Figures

APPARATUS AND METHOD FOR DRIVING CASING OR CONDUCTOR PIPE

BACKGROUND OF THE INVENTION

1. Field of the Invention

This invention relates to apparatus for driving casing, piles, or conductor pipe and more particularly to an apparatus comprising in combination; an external reciprical impact driving means supported atop the conductor pipe, internal rotatable drilling means supported within the conductor pipe, and means associated therewith for introducing air and water under pressure for creating a pressure differential to evacuate the drilling debris and cuttings to the surface. The drilling means is supported within said conductor pipe at the bottom portion thereof near the point of least energy absorbtion and rebound. The driving and drilling operations may be performed simultaneously or sequentially.

2. Brief Description of the Prior Art

Apparatus for driving casing or conductor pipe are known in the art, there are several patents which disclose various devices for accomplishing this end most of which merely provide for drilling in advance of the lower end of the casing.

Wiredal, U.S. Pat. No. 4,408,669 discloses a drilling means having a pilot bit, a reamer, and a guide member mounted in the bottom end of a casing tube, and which transmits impacts to the casing. The guide member has a plurality of channels which are segments of a spiral through which drilling debris is discharged upwardly to the casing tube.

Tschirky, U.S. Pat. No. 4,133,396 discloses a fluid motor and drill apparatus supported in the casing, with the drill extending below the lower end of the casing to drill the bore hole in advance of the casing.

Pulk, et al, U.S. Pat. No. 3,870,114 discloses a ground drilling apparatus which is operated from within a casing which is sunk into the hole drilled by the drill unit. The casing is pulled without rotation into the hole by a drill bit which includes a pilot bit having an axis which coincides with the centerline of the drill hole and is parallel to and separate from the cendral axis of the drill unit which is the line of action of the percussion force.

Sewell, U.S. Pat. No. 2,330,083 discloses a wireline retractable drill bit which is locked into drilling position within a casing by outwardly extendable dog members.

Kammerer, U.S. Pats. Nos. 3,097,706 and 3,097,707 discloses an apparatus for drilling well bores with casing. The apparatus is lowered through a bore of a string of drill pipe that will form the ultimate casing for the well bore, positively coupled to the lower portion thereof, and rotating the casing the accomplish the drilling of the bore.

Kammerer, U.S. Pat. No. 3,196,960 discloses a fluid expansible rotary drill bit in which greater fluid pressure can be developed in the bit for expanding its cutters outwardly, and in which the bit permits a large flow of circulating fluid through it for cleaning the bit and flushing the cuttings from the well bore.

The following patents of interest issued to Brown disclose apparatus for drilling wells using the casing itself as the drill string: U.S. Pats. Nos. 3,552,507; 3,552,507; 3,552,508; 3,552,509; 3,552,510; 3,656,564; and 3,747,675 disclose apparatus employing well casing as the drill string, a drill bit having radially expansible cutters insertable and removable through the bore of the casing and releasably connected thereto, and a drive connection means releasably insertable into the upper end of the casing bore including gripping means engageable with the casing bore for transmitting rotational torque to the casing.

The prior art in general, and none of these patents in particular, disclose the present apparatus for driving casing, piles, or conductor pipe into the ground which comprises in combination, an external reciprical impact driving means supported atop the conductor pipe, internal rotatable drilling means supported within the conductor pipe, and means associated therewith for introducing air and water under pressure for creating a pressure differential to evacuate the drilling debris and cuttings to the surface. The drilling means being supported within said conductor pipe at the bottom portion thereof near the point of least energy absorbtion and rebound.

SUMMARY OF THE INVENTION

It is therefore an object of the present invention to provide a method and apparatus for simultaneously or sequentially drilling a pilot hole, driving a conductor pipe, and extracting drilling debris from the drilled bore.

Another object of this invention is to provide a method and apparatus whereby less energy is required to drive a conductor pipe into difficult soil formations.

Another object of this invention is to provide a method and apparatus which will greatly reduce the cost of driving conductor pipe by reducing the time consumed by repeated driving, backing out, and jetting operations now required in when encountering extremely hard driving conditions.

A further object of this invention is to provide a method and apparatus which will greatly reduce the cost of driving conductor pipe by allowing the use of conductor pipe having a thinner wall thickness than is now required to absorb the energy required to drive it.

Other objects of the invention will become apparent from time to time throughout the specification and claims as hereinafter related.

The above noted objects and other objects of the invention are accomplished by an apparatus for driving casing, piles, or conductor pipe into the ground which comprises in combination, an external reciprical impact driving means supported atop the conductor pipe, internal rotatable drilling means supported within the conductor pipe, and means associated therewith for introducing air and water under pressure for creating a pressure differential to evacuate the drilling debris and cuttings to the surface. The drilling means being supported within said conductor pipe at the bottom portion thereof near the point of least energy absorbtion and rebound.

Figure 1:
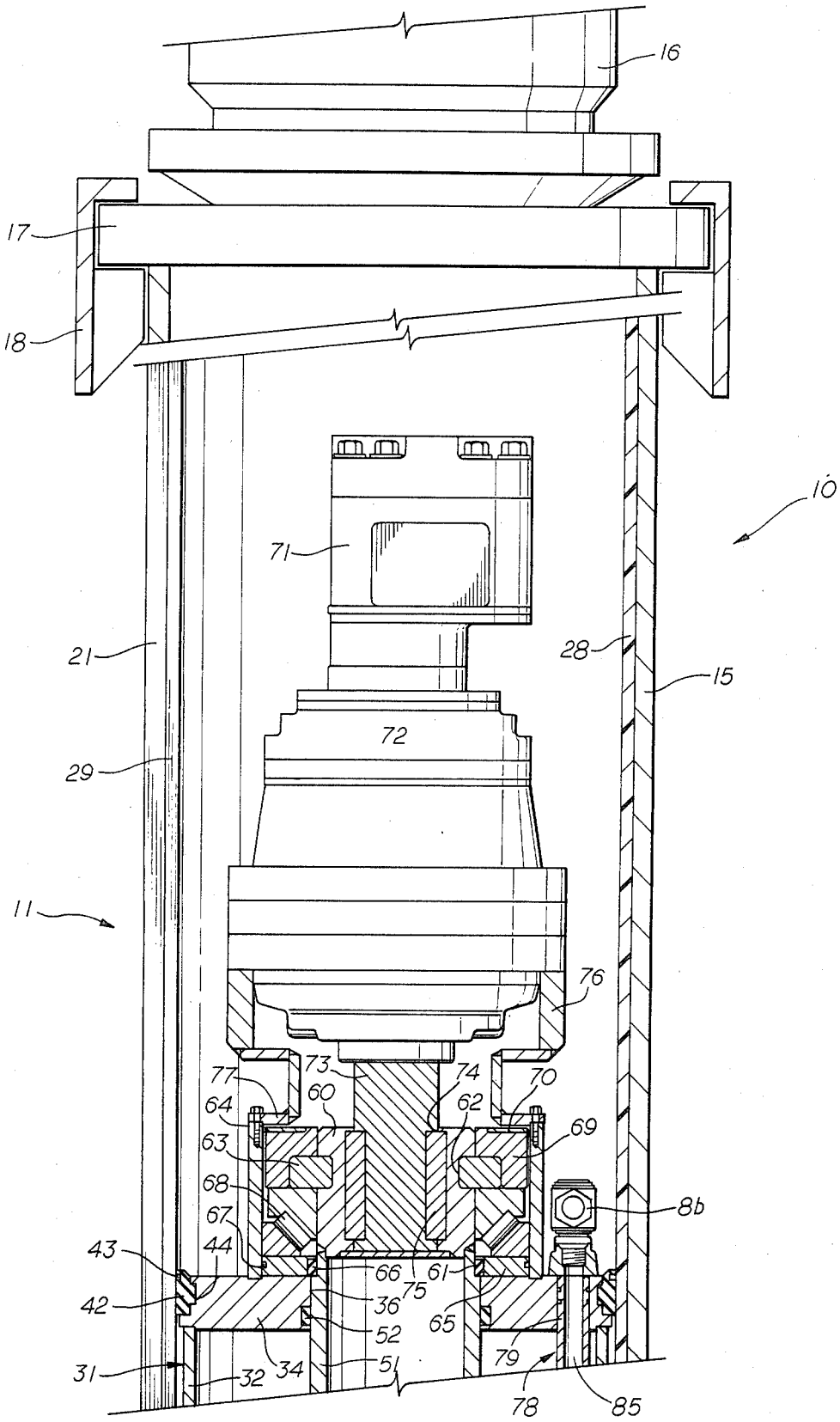
FIGS. 1 through 5 are detailed elevational views in cross section of portions of a preferred tool for driving casing or conductor pipe in accordance with the present invention.
Figure 2:
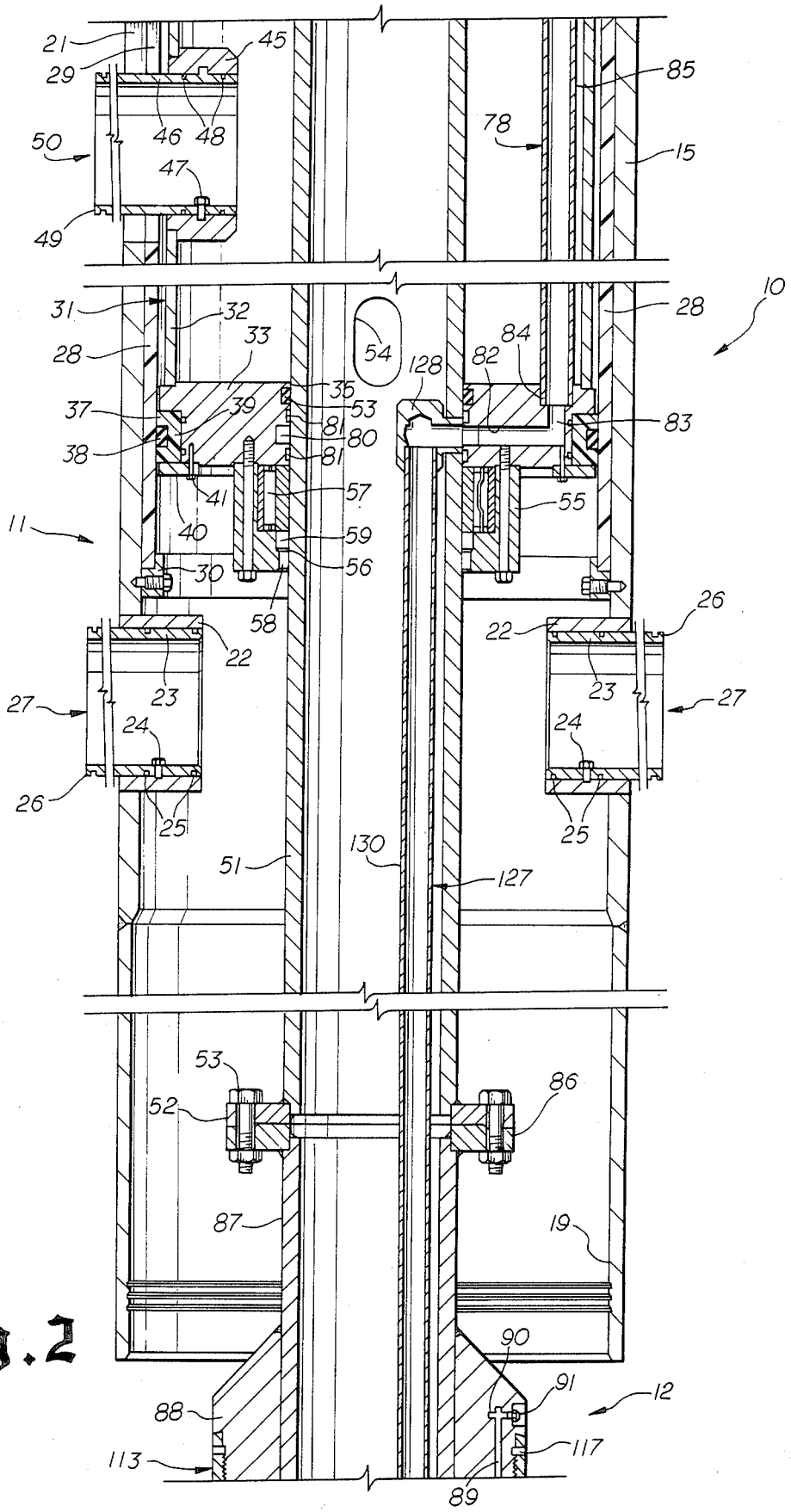

A hollow cylindrical liner 28 of suitable low friction material such as PVC plastic extends upwardly from just above the collars 22 to terminate a distance above the slots 21 and is provided with opposing circumferentially disposed slots 29 which match those of the housing 15. The liner 28 is secured at its bottom end to the inner diameter of the housing 15 by an annular retaining ring 30 screwed to the inner diameter of the housing 15. The liner 28 provides a reduced friction inner surface on the upper section of the housing 15.

A returns chamber 31 is concentrically disposed within the housing 15 to travel vertically along the lined portion thereof. The chamber 31 comprises a hollow cylindrical drum member 32 having an outer diameter less than the inner diameter of the liner 28. The drum 32 is enclosed by a flat cylindrical bottom plate 33 secured to its bottom end and a flat cylindrical top plate 34 secured to its top end. Centrally disposed circular openings 35 and 36 are provided in the bottom plate 33 and top plate 34 respectively in longitudinal axial alignment. A lower annular nylon reciprical seal 37 having a cooperative poly seal 38 peripherally disposed therein is secured in a circumferential groove 39 on the outer periphery of the bottom plate 33 to provide sliding contact with the inner surface of the liner 28. The lower seal 37 is retained in the groove 39 by a flat cylindrical retaining ring 40 secured to the bottom surface of the bottom plate 33 by bolts 41. An upper annular nylon reciprical ring 42 having a cooperative o-ring seal 43 peripherally disposed therein is secured in a circumferential groove 44 on the outer periphery of the top plate 34 to provide sliding contact with the inner surface of the liner 28, and serves as a wiper ring and shock absorbing means.

Two opposed hollow cylindrical collars 45 (only one shown) secured to the circumference of the drum 32 intermediate the top plate 34 and the bottom plate 33 extend inwardly into the chamber 31 a short distance and each receives a nipple 46 which is secured therein by set screws 47. The nipple members 46 extend outwardly from the collars 45 and are provided with circumferential seals 48 to form a fluid tight seal on the inner diameter of the collars 45 and their extended end 49 is adapted to receive conventional hose connections. The collars 45 and nipples 46 provide an outlet 50 from the returns chamber 31 to discharge drilling debris from within the chamber to a suitable destination. Only one outlet 50 is shown, so that other parts of the drawing may be shown and described more clearly. The outlets 50 extend outwardly through, and travel longitudinally within the slots 21 and 29.

An elongated hollow cylindrical upper rotation drive tube 51 is concentrically disposed within the chamber 31 and extends downwardly therethrough. The drive tube 51 is rotatably received within the circular openings 35 and 36. A rotary poly seal element 52 is provided between the outer diameter of the tube 51 and the top plate 34 and an opposing poly seal 53 is provided between the outer diameter of the tube 51 and the bottom plate 33 where the tube 51 passes through.

At least one elongated circular opening 54 is provided on the circumference of the tube 51 just above the top surface of the bottom plate 33 to provide communication between the inside of the tube 51 and the inside of the chamber 31.

A generally cylindrical cup shaped lower bearing carrier 55 having a central opening 56 to rotatably receive the downwardly extending portion of the tube 51 is bolted to the bottom surface of the bottom plate 33. A roller bearing 57 is provided in the upper portion of the carrier 55 and a rotary poly seal 58 is provided in the bottom portion thereof to provide a seal between the outer diameter of the tube 51 and the carrier 55. An annular oil seal 59 is disposed directly below the bearing 57 to retain the bearing lubricant.

A cylindrical drive shaft connector 60 is secured to the reduced diameter upper end of the rotation drive tube 61 which extends upwardly a short distance from the top plate 34. The outer diameter of the connector 60 is provided with an annular groove 62 and to receive a split ring 63. A cylindrical upper bearing carrier 64 is secured at its bottom end to the top surface of the top plate 34. A flat cylindrical lower spacer ring 65 having a central circular opening which rotatably receives the reduced diameter 61 of the drive tube 51 is disposed within the carrier 64 at the lower portion. An oil seal 66 is provided between the tube 51 and the ring 65, and an o-ring seal 67 is disposed between the circumference of the spacer ring 65 and the inner diameter of the carrier 64. A spherical thrust bearing 68 is supported on the spacer 65 and is in operational contact with inner diameter of the carrier 64 and the outer diameter of the connector 60. A spring ring 63 is received within the groove 62 and is supported on the top of bearing 68. An annular split ring housing 69 surrounds the split ring 63. The upper surface of the split ring housing 69 is provided with a brass thrust bushing 70.

Rotary motion to the upper rotation drive tube 51 is provided by means of a conventional hydraulic motor 71 through a planetary reduction gear 72 disposed therebelow and provided with a downwardly extending drive shaft 73. The connector 60 is provided with a central opening 74 which is adapted to receive the extended end of the shaft 73 and the shaft is secured thereto by keys 75. The upper cylindrical portion of a gear box adapter 76 receives and supports the planetary gear 72 and motor 71. The lower portion of the adapter 76 is provided with a flange 77 which is bolted to the top surface of the upper carrier 64. The flange 77 also retains the aforementioned components within the carrier 64.

An isolated air inlet passageway 78 is provided through the returns chamber 31 between the top plate 34 and the bottom plate 33. A vertical bore 79 spaced radially outward from the central longitudinal axis is provided in the top plate 34. The bottom plate 33 is provided with an annular groove 80 within the central opening 35. Annular seals 81 above and below the groove 80 provide an air seal between the groove 80 and the tube 51. An air passage bore 82 extends laterally outward from the groove 80 to terminate a distance from the periphery of the bottom plate 33. A vertical bore 83 in longitudinal axial alignment with the bore 79 in the top plate 34 extends downward from the top surface of the bottom plate 33 to communicate with the lateral bore 82 and groove 80. A counter bore 84 of the same diameter as the bore 79 in the top plate 34 and in longitudinal axial alignment therewith extends downward a short distance from the top surface of the bottom plate. One end of a tubular air supply conduit 85 is received within the bore 79 and the opposed end is received within the counter bore 84. The ends of the conduit 85 are provided with seals to provide an isolated air passageway through the chamber 31. A conventional hose connection 86 is provided atop the bore 79 to supply air to the conduit 85.

The bottom end of the upper rotation drive tube 51 is provided with a flange 52 which is connected by bolts 53 to the mating flange 86 of a latch drive tube 87. The latch drive tube 87 is of the same internal and external diameter as the upper rotation drive tube 51 and extends downwardly therefrom to form the central member of the latch assembly 12.

The latch assembly 12 comprises a cylindrical latch nipple 88 which is welded onto the outer periphery of the latch drive tube 87. A small bore 89 spaced radially outward from the longitudinal axis extends vertically upwardly a distance from the bottom surface of the nipple 88 to communicate with a small horizontal bore 90 extended to the exterior of the nipple 88 to provide a pressure inlet. A zerk fitting 91 is secured into the bore 90 for connection to a suitable pressurizing means. The bottom portion of the latch drive tube 87 is provided with external threads 92 which engage mating internal threads 93 on the internal diameter a cylindrical bottom flange 94. A set screw 95 secures the bottom flange 94 to the latch drive tube 87.

The cylindrical bottom flange 94 is provided with an air passage bore 96 spaced radially outward from the longitudinal axis and extended upwardly a distance from the bottom surface of the bottom flange 94 to communicate with a horizontal bore 97 extended inwardly to an annular groove 98 above the internal threads 93. Seals 99 are provided above and below the groove 98 to form a rotary seal on the outer diameter of the latch drive tube 87. A connecting nipple or latch air stinger 100 is sealably secured into the bottom portion of the bore 96 and extends downwardly a distance therefrom. A pressure relief bore 101 spaced radially outward from the longitudinal axis extends downwardly a distance from the top surface of the bottom flange 94 to intersect a horizontal bore 102 to establish communication with atmosphere. A plurality of pins 103 are press fitted into the bottom of the bottom flange 94 and extend downwardly a short distance therefrom. The pins 103 are positioned radially outward from the longitudinal axis to be in axial alignment with the bolt circle of the mating flange 104 of a drive tube 105. A reduced diameter tubular extension or guide tube 106 is attached in axial alignment to the bottom surface of the bottom flange 94 and extends downwardly therefrom to be slidably received within the drive tube 105. Circumferential annular seals 107 are provided on the guide tube 106 near its juncture with the bottom flange 94 to seal on the inner diameter of the drive tube 105. A pair of opposed tapered openings 108 extend angularly and upwardly from the bottom of the guide tube 106 to terminate in an elongated narrow slot 109. The openings receive and guide a pin 110 disposed transversely through the drive tube 106 to align the depending pins 103 into the bolt holes 111 and the latch air stinger 100 into an air conduit 112.

A cylindrical latch dog member 113 having an internally threaded upper portion 114 and a slotted expandable bottom portion 115 is threadably received on mating external threads 166 of the nipple 88 and retained thereon by a set screw 117. The slotted bottom portion 115 forms a series of expandable fingers or collets 118. The internal diameter of the dog member 113 extends straight down from the threaded portion 114 a distance below the top of the slots 115 and travels angularly inward and down to form a tapered surface 119. At the inward termination of the tapered surface 119 an annular horizontal top shoulder 120 is defined by a large diameter which extends downwardly therefrom to terminate at a second opposing annular horizontal bottom shoulder 121. The top surface of the cylindrical bottom flange 94 is captured below the top shoulder 120 and the bottom surface of the flange 94 is held by the bottom shoulder 121.

A cylindrical latch piston 122 is slidably received on the outer diameter of the latch drive tube 87 and within the inner diameter of the latch dog 113. An annular reciprocating seal 123 is provided between the outer diameter of the tube 87 and the inner diameter of the piston 122. Another reciprocating annular seal 124 is provided between the outer diameter of the piston 122 and the inner diameter of the latch dog 113 above the slotted portion 115. A counterbore 125 extends upwardly a distance from the bottom of the piston 122 to receive one end of a compression spring 126. The other end of the spring 126 is biased on the top surface of the bottom flange 94 to urge the piston 122 upwardly to a position just below the bottom of the latch nipple 88.

When pressure is applied through the zerk fitting 91 the piston 122 travels down on the tapered surface 119 to expand the collets 118 and release their grip on the mating flange 104 to add or remove sections of drill tube below the latch assembly 12 as length requirements change.

An internal air passageway 127 is provided between the returns chamber 31 and the latch assembly 12 within the upper rotation drive tube 51 and the latch drive tube 87 and extends downwardly along the inner diameters thereof. An ell fitting 128 is disposed within the upper rotation drive tube 87 the inlet of which extends through the tube 51 and is secured thereto in horizontal alignment with the groove 80 of the bottom plate 33. A second opposing ell fitting 129 disposed within the latch drive tube 87 the outlet of which extends through the tube 87 and is secured thereto in horizontal alignment with the groove 98 in the bottom flange 94. The ell fittings 128 and 129 are in longitudinal axial alignment. One end of an elongated tubular air supply conduit 130 is received within the outlet of the ell fitting 128 and the opposed end is received within the inlet of the ell fitting 129. The ends of the conduit 130 are provided with seals to provide an isolated air passageway within the tubes 51 and 87. The air passageway continues through the bottom flange 94 and to the latch air stinger 100.

Figure 3:
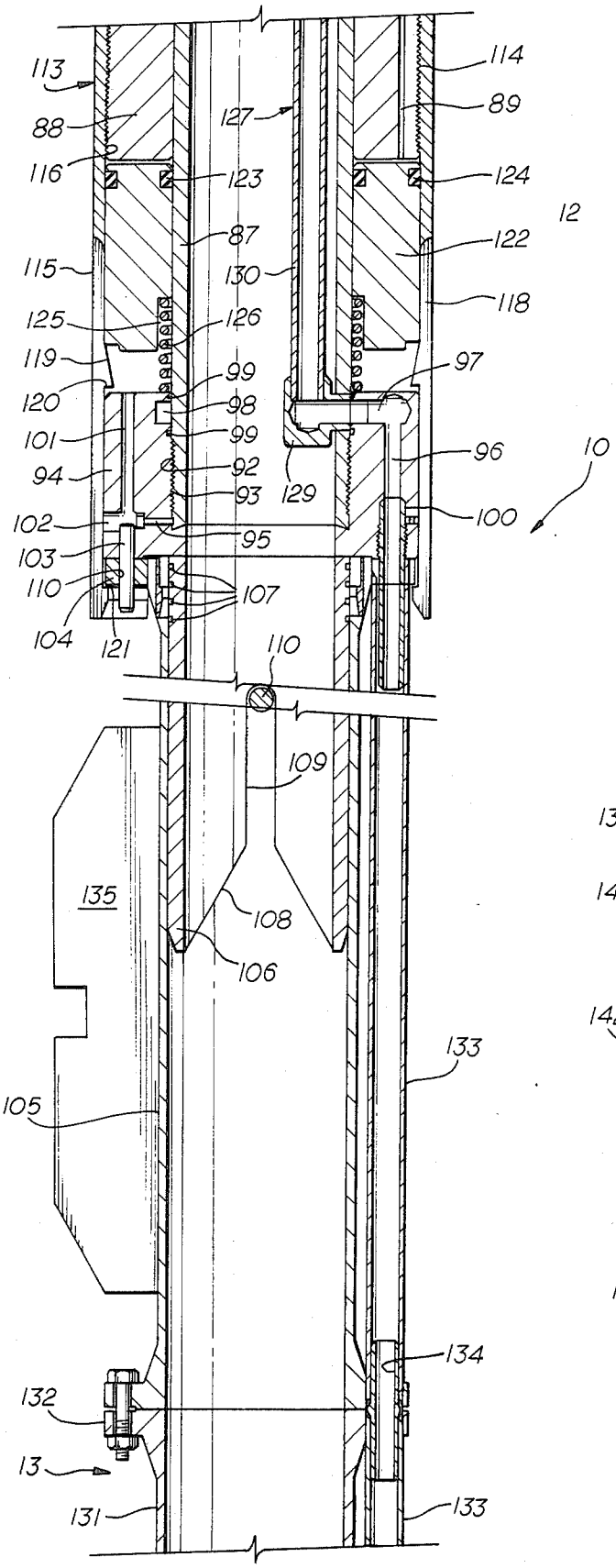
Figure 4:
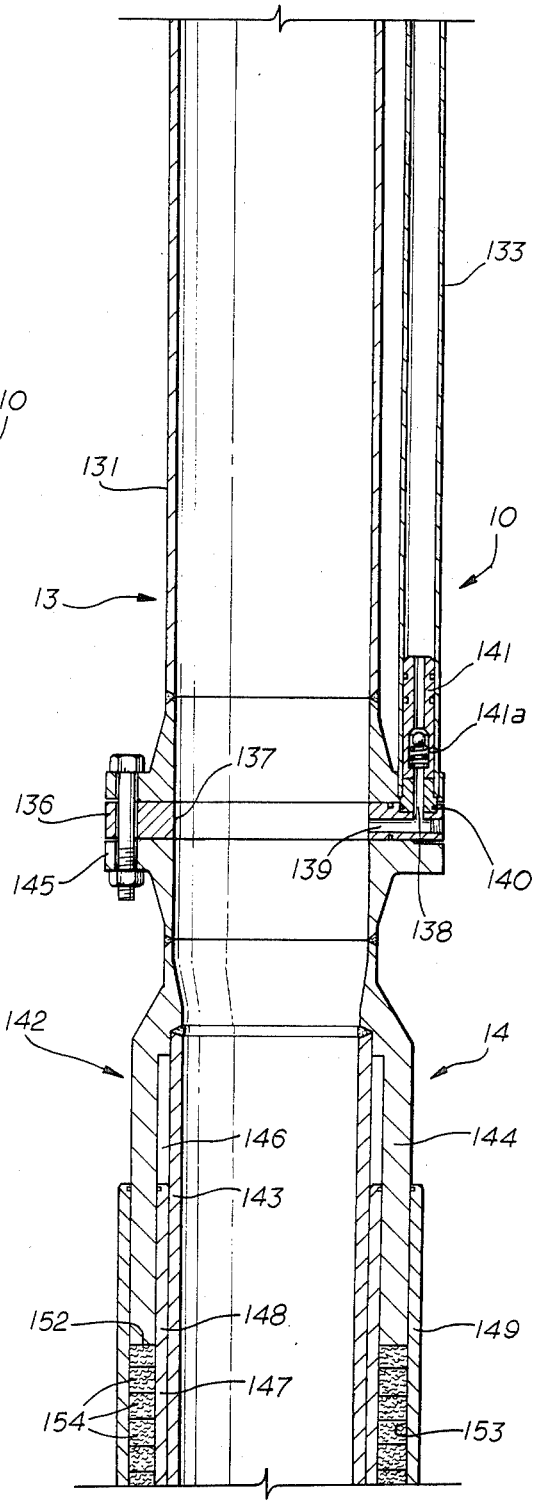

The drive string assembly 13 (FIGS. 3 and 4) comprises one or more elongated sections of drive tubes 131 having a flange 132 at each end. Air passage conduit 133 laterally offset from the drive tube 131 extends between the flanges. Successive sections of drive tubes are added by operation of the latch assembly 12 in the manner previously described, and conventionally bolted together with the air passage conduits 133 in longitudinal alignment. As the flanges are being aligned for bolting, conventional stingers 134 are placed within opposing ends of the air passage conduit 133 providing an air tight junction therebetween when the flanges are made up. Certain sections of drive tubes 131 may be provided with stabilizer fins to maintain vertical alignment inside the conductor pipe 20. A flat cylindrical air injector flange 136 having a central bore 137 is bolted between the lowermost drive tube 131 and the flange 145 of a shock absorbing nipple 142 (described hereafter). An air passage bore 138 spaced radially outward from the longitudinal axis extend vertically downward from the top surface of the flange 136 to communicate with a horizontal bore 139 extended radially outward from the central bore 137.

A counterbore 140 concentric with the air passage bore 138 receives one end of a check valve stinger 141. One end of the check valve stinger is sealably secured into the counterbore 140 and the opposing end extends vertically upward to be sealably received within the air passage conduit 133 of the lowermost drive tube 131. The check valve stinger 141 contains a check valve mechanism 141a to allow air under pressure to be directed only into the drive tube 131 through the passageways 138 and 139. The air injector flange 136 will fit between any flanged connections on the assembly 10.

Figure 5:
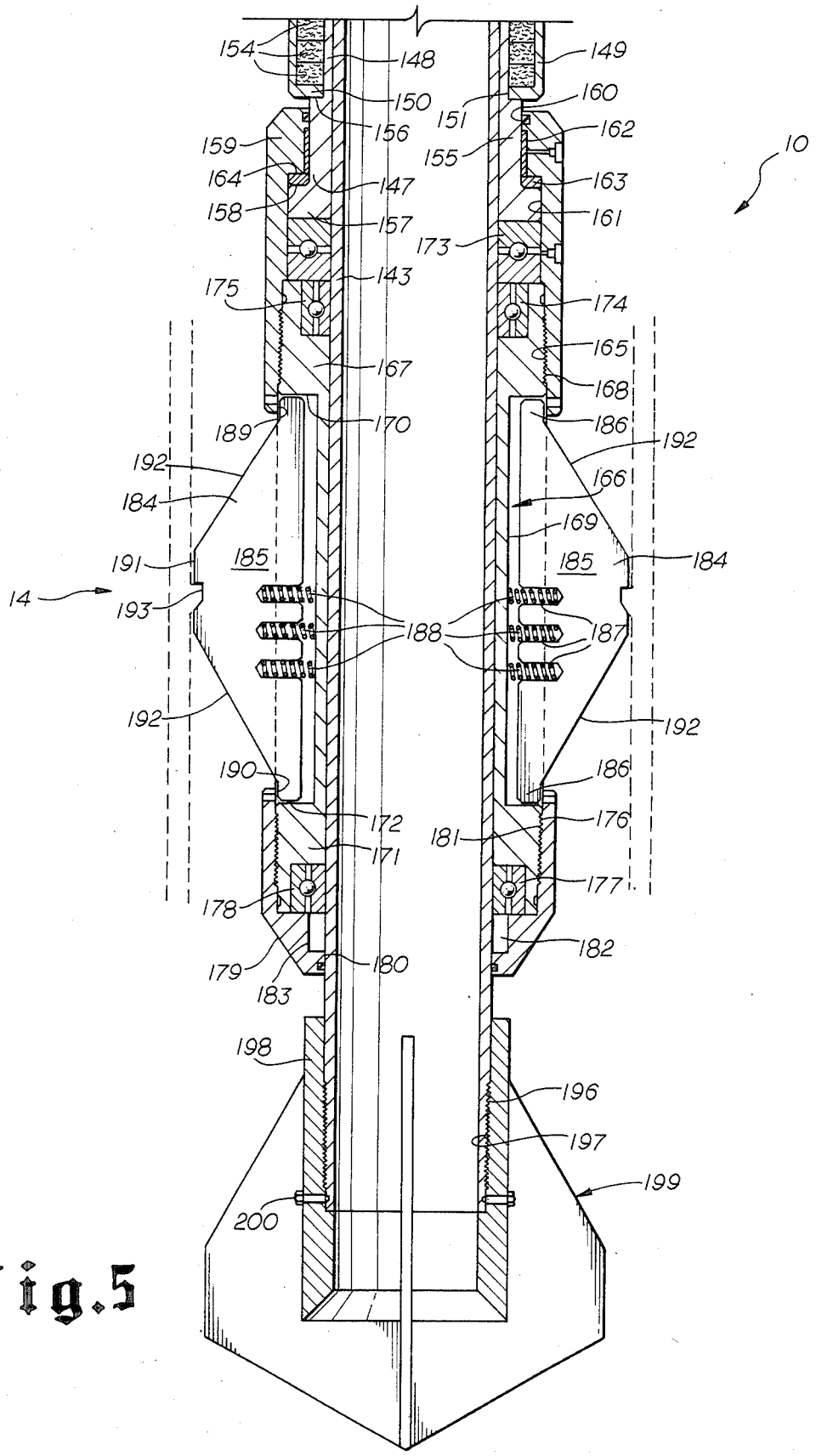

The lower assembly 14 (FIGS. 4 and 5) comprises a shock absorbing nipple 142 which is made up an elongated inner tubular member or drill bit drive string 143 and a shorter concentric outer cylindrical member 144 joined at their upper ends. A flange 145 at the top of the outer member joins the nipple 142 to the air injector flange 136. The difference between the outer diameter of the drive string 143 and the inner diameter of the outer member 144 forms a cylindrical cavity 146 therebetween. A cylindrical thrust spool carrier 147 slidably received on the drive string 143 has a thin cylindrical vertical upper portion 148 which is telescopically received within the cavity 146. A thin cylindrical cup shaped outer housing 149 has a bottom 150 provided with a concentric opening 151 which is slidably received on the vertical upper portion 148 of the carrier 147. The inner surface of the cylindrical wall of the housing 149 is slidably received on the outer circumference of the nipple 144, and the bottom portion 150 is spaced downwardly from the bottom surface 152 of the nipple 144 to form an enclosed cylindrical cavity around the vertical upper portion 148 of the carrier 147. Several layers or rings of conventional shock absorbing material 154 are disposed within the cavity 153. An intermediate portion 155 of the carrier 147 is of larger diameter than the upper portion 148 to define an annular shoulder 156 therebetween which supports the bottom 150 of the housing 149. The bottom portion 157 of the carrier 147 is of larger diameter than the intermediate portion 155 to define an annular shoulder 158 therebetween. An inverted cup shaped cylindrical upper bearing retainer cap 159 has a central opening 160 which is slidably received on the intermediate portion 155 of the carrier 147 and the diametrically larger inner surface 161 of the cylindrical wall is slidably received on the circumference of the bottom portion 157. A cylindrical thrust bushing 162 is disposed between the intermediate portion 155 of the carrier 147 and the top portion of the cap 159. A flat annular thrust bushing 163 is disposed between the shoulder 158 and an opposing shoulder 164 on the cap 159. The bottom portion of the upper bearing cap 159 is provided with internal threads 165 which extend upwardly therefrom.

A cylindrical lock-in stabilizer spool 166 is slidably received on the circumference of the drill bit drive tube 143. The spool 166 has a cylindrical upper portion 167 provided with external threads 168, an intermediate portion provided with longitudinal, radially opposed slots 169, and a cylindrical bottom portion 171. Each end of the slots 169 form an upper shoulder 170 and a lower shoulder 172. The top portion 167 is threadably secured into the upper cap 159 with the shoulder 170 slightly above the bottom surface of the cap 159. The top surface of the spool 166 is spaced from the bottom surface of the carrier 147 and a thrust bearing 173 is disposed therebetween. A spherical roller bearing 174 is disposed between the drive tube 143 and a counterbore 175 in the top portion 167. The bottom portion 171 of the spool 166 is provided with external threads 176 and a central counterbore 177. A spherical roller bearing 178 is disposed between the drive tube 143 and the counterbore 177.

A generally cup shaped cylindrical lower bearing retainer cap 179 has a central opening 180 which is slidably received on the drive tube 143. The upper portion of the cap 179 is provided with internal threads 181. A thrust bearing 182 is disposed between the circumference of the tube 143 and a bearing recess 183 in the lower portion of the cap 179. The upper portion of the cap 179 is threadably secured onto the lower portion of the spool 166 with the shoulder 172 slightly below the top surface of the cap 179.

A set of four circumferentially spaced apart radially opposed lock-in blades 184 are slidably disposed within the slots 169 around the circumference of the intermediate portion of the spool 166 between the shoulders 170 and 172. Each blade 184 is comprised of an outwardly extending intermediate blade portion 185 and at each end a flat rectangular tongue portion 186 extending vertically therefrom. A series of horizontal bores 187 in the blade portion receive compression springs 188 which are biased against the inner surface of slots 169 to urge the blades outwardly therefrom. The tongue portions 186 ride outwardly on the shoulders 170 and 172 and are contained within the exposed portions of 189 and 190 of the upper and lower caps 159 and 179. The extended outer surface of the blades portions are provided with a short straight vertical surface 191 and opposing angular surfaces 192 which travel inwardly to terminate just below the top of the tongue portions 186. A lock-in notch 193 is provided in the straight vertical portion 191. As the tool travels downwardly within the conductor pipe 20 the blades 184 expand outwardly to ride on the interior of the conductor 20.

A landing nipple 194 is provided on the lower portion of the conductor pipe 20. The interior of the landing nipple 194 is provided with a stop shoulder 195 which corresponds in profile to the notch 193. When the blades 184 reach the shoulder 195, they will expand to become locked therein against further downward movement.

The extended end of the drill bit drive tube 143 is provided with threads 196 which receive the internal threads 197 of the collar portion 198 of the drill bit 199. A retaining bolt 200 further secures the collar to the drive tube 143. The drill bit collar 198 is open ended to accept drilling debris and returns into the drive tube where they are carried upward and discharged as hereinafter described.

Figure 6:
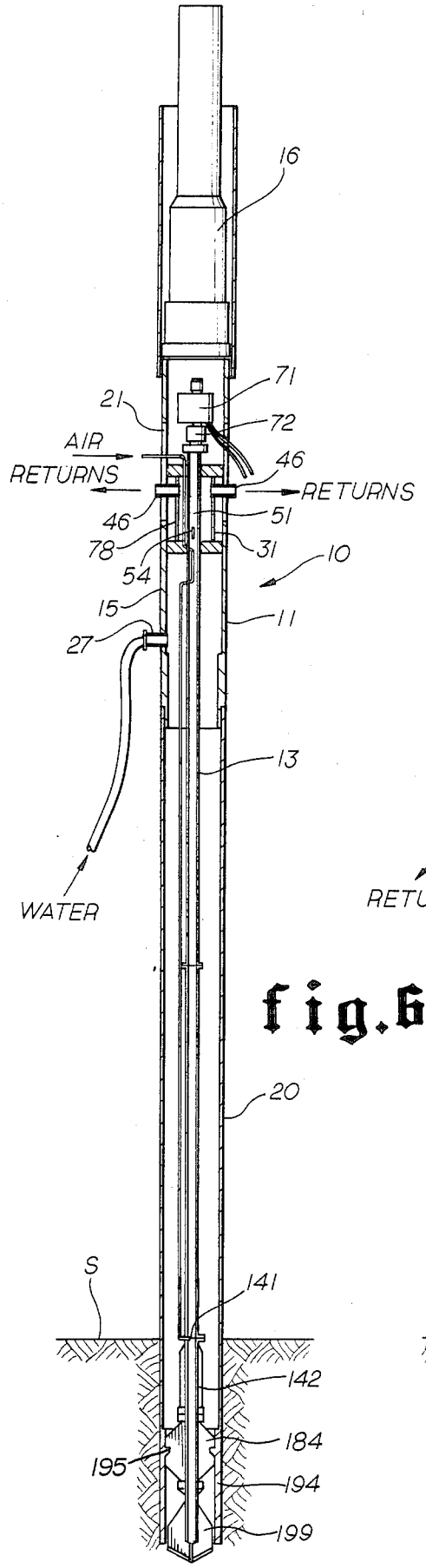
FIG. 6 is a schematic elevational view in cross section illustrating one method and a preferred embodiment of the apparatus for driving casing or conductor pipe.
Figure 7:
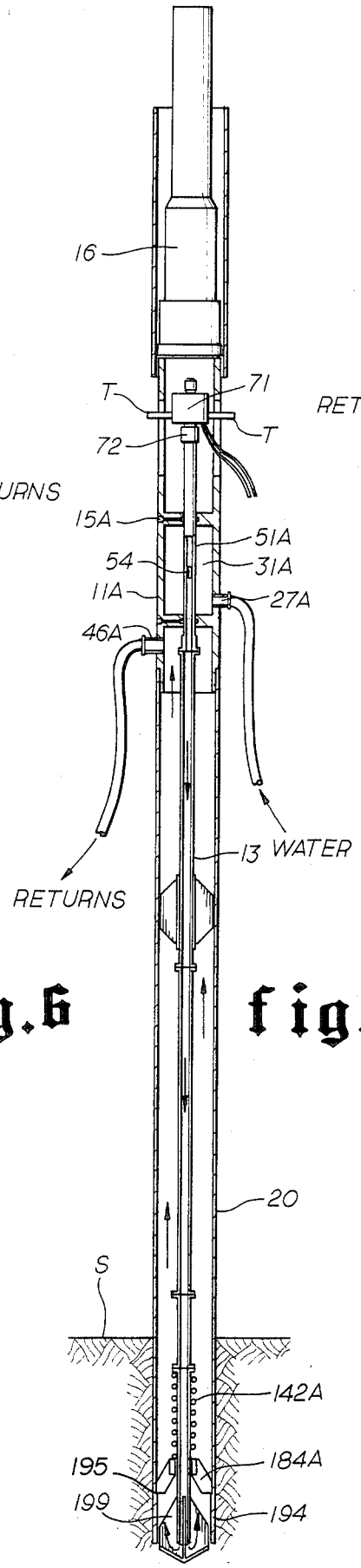
FIG. 7 is a schematic elevational view in cross section illustrating another method and an alternate embodiment of the apparatus for driving casing or conductor pipe.
Figure 8:
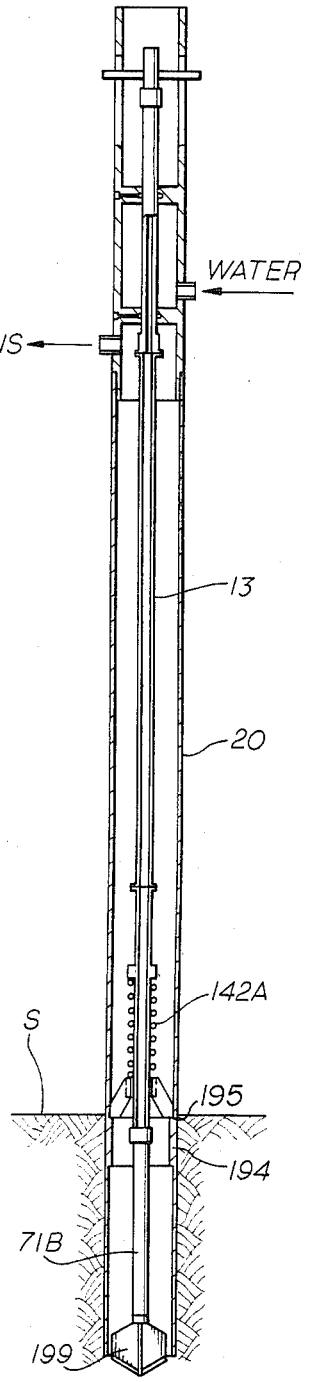
FIG. 8 is a schematic elevational view in cross section illustrating another method and an alternate embodiment of the apparatus for driving casing or conductor pipe. cDESCRIPTION OF THE PREFERRED EMBODIMENT Referring now to FIGS. 1 through 5, a preferred embodiment of the apparatus 10 comprises an upper drive assembly 11 (FIGS. 1 and 2), a latch assembly 12 (FIGS. 2 and 3), a drive string assembly 13 (FIGS. 3 and 4), and a lower assembly 14 (FIGS. 4 and 5). The upper drive assembly 11 comprises an elongated hollow cylindrical housing 15. A conventional reciprocating percussion hammer 16, impact block 17, and helmet member 18 are supported at the top end of the housing 15. The bottom end of the housing 15 is provided with suitable connecting means 19 for securing the housing 15 to the top of a section of conductor pipe 20. Two opposing elongated longitudinal slots 21 are disposed on the circumference of the upper portion of the housing 15 (shown only on one side). Two opposed hollow cylindrical collars 22 secured to the circumference of the housing 15 intermediate the slots 21 and the connecting means 19 extend inwardly into the housing 15 a short distance and each receives a nipple 23 which is secured therein by set screws 24. The nipple members 23 extend outwardly from the collars 22 and are provided with circumferential seals 25 to form a fluid tight seal on the inner diameter of the collars 22 and their extended end 26 is adapted to receive conventional hose connections. The collars 22 and nipples 23 provide a fluid inlet 27 into the housing 15 from a suitable source.

Referring now to FIGS. 6, 7, and 8, there are illustrated several methods and apparatus for setting a casing or conductor pipe in accordance with the present invention. FIG. 6 illustrates schematically one method of setting a casing or conductor pipe in the ground using a preferred apparatus 10. As shown, the conductor pipe 20 is driven into the soil S until it stops by the conventional reciprocating hammer 16 mounted at the top. The hammer is removed and the assembly is lowered inside the conductor pipe 20 until the upper drive assembly 11 contacts the top of the conductor pipe. The upper drive assembly 11 is made up and the drive string assembly 13 is lowered further until the lock-in blades 184 disposed at the lower end of the drive string 13 are received into mating shoulders in the landing nipple 194 affixed to the bottom of the conductor pipe 20 and the drill bit 199 comes to rest on the soil at the bottom of the conductor pipe 20. A shock absorbing nipple 142 is disposed directly above the drill bit. The hammer 16 is placed on top of the upper drive assembly 11 with a conventional impact block disposed therebetween.

The upper drive assembly 11 comprises a hydraulic rotary motor 71 and gear box 72 mounted at the top and coupled to the upper rotation drive tube 51 which passes through the cylindrical returns chamber 31 slidably disposed within the cylindrical housing 15 of the assembly 11. Air under pressure is introduced into the lower portion of the drive string 13 through the air injector flange 136 to exit through slots 54 in the rotation drive tube 51 and outlet nipples 46 in the returns chamber 31. The nipples 46 protrude outwardly through slots provided in the upper portion of the housing 15. Air supply conduit 78 bypasses the upper portion of rotation drive tube 51. The purpose of the slot arrangement is to provide a means whereby the bottom portion of the rotation drive tube may be extended below the bottom of the housing 15 sufficiently to connect additional sections of drill string as they are required.

Sea water is introduced under pressure through inlets 27 in the housing 15 to flow into the area between the outer surface of the drive string 13 and the inner surface of the conductor pipe 20. A pressure differential is created between the hydrostatic head of the sea water column and the reduced pressure within the drill string to effectively evacuate drilling debris and cuttings from the drilled hole and eject them through the outlet nipples 46. With the apparatus thus assembled, rotary drilling and reciprocal hamering actions may begin.

The driller may coordinate drilling speed with the driving action by observing the outlet nipples. As the soil plug is moving up in the conductor pipe, the nipples will ride up in the slots to indicate that drilling speed should be increased to get the drill bit back down to the landing nipple.

It should be noted that the apparatus is supported near the drill bit on the landing nipple at the bottom of the conductor pipe where the least energy absorbtion and rebound is noticed, and the percussion force applied to the casing by the driving hammer is absorbed throughout the entire length of the casing and by the time it reaches the bottom, the minimal amount of force is being absorbed by the apparatus. The shock absorbing nipple further absorbes any force that is transmitted into the string to reduce fatigue problems.

FIG. 7 illustrates schematically another embodiment of the apparatus wherein the air flow arrangement is deleted and only water is used to evacuate the drilling debris and cuttings. The conductor pipe 20 is driven into the soil, the assembly is lowered inside the conductor pipe 20, and the upper drive assembly 11A is made up, as previously described. As shown, the lock-in device 184A in this embodiment comprises a plurality of flat radially expanding blade members which are pivotally connected at their upper ends to a concentric sliding ring member. A compression spring 142A disposed on the outer diameter of the drill string 13 between the sliding ring and the lower flanged connection serves as the shock absorbing device. The lock-in members 184A are received into mating shoulders in the landing nipple 194 affixed to the bottom of the conductor pipe 20.

The upper drive assembly 11A of this embodiment comprises a hydraulic rotary motor 71 and gear box 72 mounted at the top and coupled to the upper rotation drive tube 51A which passes through an isolated water chamber 31A formed in the the cylindrical housing 15A of the assembly 11A. Torque arms T protrude outwardly through slots 21A provided in the upper portion of the housing 15A.

Sea water is introduced under pressure through inlets 27A in water chamber 31A of the housing 15A to flow into slots 54A in the upper portion of the rotation drive tube 51A. The water is pumped into the annulus of the drive tube and drill string to exit at the drill bit 199. Drilling debris and cuttings are carried by the water upward in the area between the outer surface of the drive string 13 and the inner surface of the conductor pipe 20 to exit through outlets 46A provided in the lower portion of the housing 15A. With the apparatus thus assembled, rotary drilling and reciprical hammering actions may begin.

FIG. 8 shows schematically another alternate method and embodiment of the apparatus wherein various combinations of the upper housing arrangement, latching device, debris return system, and shock absorbing devices of the aformentioned embodiments may be incorporated. The conductor pipe 20 is driven into the soil, the assembly is lowered inside the conductor pipe 20, and the upper drive assembly is made up, as previously described.

In this embodiment, a down hole motor 71B is disposed in the drive string 13 between the drill bit 199 and the the shock absorbing device 142A to rotate the drill bit from the bottom of the drill string rather than rotating it from the surface as previously described. The down hole motor 71B may be a conventional down hole motor for rotating the drill bit with or without reciprocating impact capabilities.

While this invention has been described fully and completely with special emphasis upon a preferred embodiment, it should be understood that within the scope of the appended claims the invention may be practiced otherwise than is specifically described herein.

What is claimed is:

1. Apparatus for driving casing or conductor pipe into the ground comprising in combination;

a casing or conductor pipe adapted to be driven into the ground and having an internally disposed support shoulder at the bottom portion thereof, reciprocal impact driving means supported atop said casing or conductor pipe for applying percussive force thereto, a drill string assembly supported upon said support shoulder within said casing or conductor pipe for drilling a hole at the bottom thereof, said drill string supported within said casing or conductor pipe a sufficient distance beneath said impact driving means to substantially reduce the effects of percussive action imparted to said casing or conductor pipe by said driving means, a drill bit connected to the lower end of said drill string assembly, a fluid driven drilling means reasonably connected to said drilling string assembly for imparting rotary motion thereto independently from the movement of said casing or conductor pipe, and means associated with said drill string assembly for creating a fluid pressure differential between the interior and the exterior of said drill string assembly to evacuate drilling debris and cuttings from the drilled hole, said driving means and said drilling means operative simultaneously or sequentially.

2. The apparatus according to claim 1 further comprising shock absorbing means interposed between said drill string assembly and said casing or conductor pipe support shoulder for reducing the percussive force transmitted therebetween by said driving means.

3. The apparatus according to claim 1 wherein said drill string assembly is supported within said casing or conductor pipe at the bottom portion thereof near the point of least percussive action imparted to said casing or conductor pipe by said driving means.

4. The apparatus according to claim 1 wherein said drilling means comprises a down hole motor disposed in the drill string at the lower portion thereof the rotate a drill bit from the bottom of the drill string.

5. The apparatus according to claim 1 wherein said means for creating a pressure differential includes means for introducing air under pressure to the interior of said drill string assembly.

6. Apparatus for driving casing or conductor pipe into the ground comprising in combination;

a casing or conductor pipe adapted to be driven into the ground and having an internally disposed support shoulder, an elongated hollow cylindrical housing, having a top end adapted to operatively receive and support a reciprocating percussion hammer and impact block, and a bottom end provided with connecting means for securing said housing to the top of said casing or conductor pipe, opposing elongated longitudinal slots disposed on the circumference of the upper portion of said housing, at least one fluid inlet secured to the circumference of said housing longitudinally intermediate said slots and bottom end in fluid communication with the interior of said housing and having one end extending outwardly therefrom and adapted to receive hose connections for connecting said inlet to a fluid source, an enclosed hollow cylindrical chamber concentrically disposed within said housing adapted for reciprical non-rotating vertical movement therein, said chamber enclosed at its top end by a top plate member and at its bottom end by a bottom plate member, horizontally opposed fluid outlets secured to the circumference of said chamber vertically intermediate said top and bottom plate members in fluid communication with the interior of said chamber and having one end extending outwardly therefrom and adapted to receive hose connections for connecting said outlet to a discharge hose, the intermediate portion of said outlets slidably received within said slots of said housing and said liner for longitudinal reciprical movement therein, a longitudinal elongated hollow cylindrical upper drive tube member disposed concentrically within said chamber having one end extending upwardly therefrom and its other end extending downwardly therefrom, said tube secured to said chamber and journaled thereabove and therebelow for rotational movement relative thereto, said upwardly extending end provided with drive shaft connecting means and said downwardly extending end provided with a flange, at least one elongated circular opening on the circumference of said tube to provide communication between the interior of said tube and the interior of said chamber, a fluid driven motor and gear reduction means having a downwardly depending drive shaft member releasably connected to said connecting means for imparting rotary motion to said upper rotation drive tube, said motor and gear reduction means supported upon said chamber for vertical movement therewith, a hydraulically operated latch assembly having a top flange connected to said flange of said rotation drive tube and a bottom flange provided with means for releasably guiding and connecting said latch assembly to the top flange of a drive string assembly, a drive string assembly in axial alignment with said drive tube comprising one or more longitudinal hollow cylindrical tubes having a top flange and a bottom flange, the uppermost tube having its top flange releasably connected to said bottom flange of said latch assembly, a drill bit drive tube in axial alignment with said drive tube assembly comprising a longitudinal hollow cylindrical tube having a top flange and its bottom end adapted to receive a drill bit, said top flange connected to said bottom flange of said drive string tube, expandable support means carried by said drill bit drive tube adapted to expand radially outward therefrom to be received within said casing or conductor pipe on said support shoulder, shock absorbing means interposed between said drill bit drive and said expandable support means for reducing the percussive force transmitted therebetween by said driving means.

7. The apparatus according to claim 6 further comprising a hollow cylindrical liner of material having a low coefficient of friction secured to the interior surface of said housing to extend upwardly from above said inlet and terminate a distance above said slots.

8. The apparatus according to claim 6 or 7 further comprising:

an isolated air inlet passageway having a longitudinally offset stationary upper portion extending from above said top plate of said chamber, through said chamber into said bottom plate of said chamber to communicate through a first sealed rotary connection with a second portion disposed longitudinally and extending downwardly along the interior sidewall of said upper rotation drive tube and said latch assembly to communicate through a second sealed rotary connection with a longititudinally offset bore extending downwardly therefrom, said bore provided with depending connecting means to be received within an axially aligned air passage conduit which extends longitudinally adjacent the exterior of said drive string assembly between said top and bottom flanges thereof, conduit connecting means disposed between mating flanges of said drive tubes for sealably joining opposing ends of said conduit, flange connecting means for joining the bottom flange of the lowermost said drive tube to a mating flange, said flange connecting means having an air conduit connecting means in axial alignment with said air passage conduit for sealably connecting therein, said air conduit connecting means having an air passageway for establishing air communication between said air passage conduit and the interior of said drive string assembly, and a check valve disposed within said air conduit connecting means to allow air under pressure to be directed only into said drive tube.

9. Apparatus for driving casing or conductor pipe into the ground comprising in combination;

a casing or conductor pipe adapted to be driven into the ground and having an internally disposed support shoulder, an elongated hollow cylindrical housing, having a top end adapted to operatively receive and support a reciprocating percussion hammer and impact block, and a bottom end provided with connecting means for securing said housing to the top of said casing or conductor pipe, an enclosed hollow cylindrical water chamber portion disposed within said housing, said chamber enclosed at its top end by a top plate member and at its bottom end by a bottom plate member, opposing elongated longitudinal slots disposed on the circumference of the upper portion of said housing, at least one fluid inlet secured to the circumference of said housing longitudinally intermediate said top and bottom plate members in fluid communication with the interior of said water chamber and having one end extending outwardly therefrom and adapted to receive hose connections for connecting said inlet to a fluid source, at least one fluid outlet secured to the circumference of said housing vertically intemediate said bottom plate and said connecting means in fluid communication with the interior of said casing or conductor pipe and having one end extending outwarely therefrom adapted to receive hose connections for connecting said ouulet to a discharge hose, a longitudinal elongated hollow cylindrical upper drive tube member disposed concentrically within said housing having one end extending upwardly from said water chamber and its other end extending downwardly therefrom, said tube journaled thereabove and therebelow for rotational and reciprical movement relative thereto, said upwardly extending end provided with drive shaft connecting means and said downwardly extending end provided with a flange, at least one elongated circular opening on the circumference of said tube to provide fluid communication between the interior of said tube and the interior of said water chamber, a fluid driven motor and gear reduction means having a downwardly depending drive shaft member releasably connected to said connecting means for imparting rotary motion to said upper rotation drive tube, said motor and gear reduction means supported upon said drive tube for vertical movement therewith, at least two opposing arms connected to said motor and gear reduction means and extending outwardly therefrom, the intermediate portion of which are slidably received within said slots of said housing for longitudinal reciprical movement therein, a hydraulically operated latch assembly having a top flange connected to said flange of said rotation drive tube and a bottom flange provided with means for releasably guiding and connecting said latch assembly to the top flange of a drive string assembly, a drive string assembly in axial alignment with said drive tube comprising one or more longitudinal hollow cylindrical tubes having a top flange and a bottom flange, the uppermost tube having its top flange releasably connected to said bottom flange of said latch assembly, a drill bit drive tube in axial alignment with said drive tube assembly comprising a longitudinal hollow cylindrical tube having a top flange and its bottom end adapted to receive a drill bit, said top flange connected to said bottom flange of said drive string tube, expandable support means carried by said drill bit drive tube adapted to expand radially outward therefrom to be received within said casing or conductor pipe on said support shoulder, shock absorbing means interposed between said drill bit drive tube and said expandable support means for reducing the percussive force transmitted therebetween by said driving means.

10. Apparatus for driving casing or conductor pipe into the ground comprising in combination;

a casing or conductor pipe adapted to be driven into the ground and having an internally disposed support shoulder, an elongated hollow cylindrical housing, having a top end adapted to operatively receive and support a reciprocating percussion hammer and impact block, and a bottom end provided with connecting means for securing said housing to the top of said casing or conductor pipe, an enclosed hollow cylindrical water chamber portion disposed within said housing, said chamber enclosed at its top end by a top plate member and at its bottom end by a bottom plate member, opposing elongated longitudinal slots disposed on the circumference of the upper portion of said housing, at least one fluid inlet secured to the circumference of said housing longitudinally intermediate said top and bottom plate members in fluid communication with the interior of said water chamber and having one end extending outwardly therefrom and adapted to receive hose connections for connecting said inlet to a fluid source, at least one fluid outlet secured to the circumference of said housing vertically intermediate said bottom plate and said connecting means in fluid communication with the interior of said casing or conductor pipe and having one end extending outwarely therefrom adapted to receive hose connections for connecting said ouulet to a discharge hose, a longitudinal elongated hollow cylindrical upper drive tube member disposed concentrically within said housing having one end extending upwardly from said water chamber and its other end extending downwardly therefrom, said tube journaled thereabove and therebelow for reciprical movement relative thereto, said upwardly extending end provided with at least two opposing arms connected thereto and extending outwardly therefrom, the intermediate portion of which are slidably received within said slots of said housing for longitudinal reciprical movement therein, and said downwardly extending end provided with a flange, at least one elongated circular opening on the circumference of said tube to provide fluid communication between the interior of said tube and the interior of said water chamber, a hydraulically operated latch assembly having a top flange connected to said flange of said rotation drive tube and a bottom flange provided with means for releasably guiding and connecting said latch assembly to the top flange of a drive string assembly, a drive string assembly in axial alignment with said drive tube comprising one or more longitudinal hollow cylindrical tubes having a top flange and a bottom flange, the uppermost tube having its top flange releasably connected to said bottom flange of said latch assembly, a drill bit drive tube in axial alignment with said drive tube assembly comprising a longitudinal hollow cylindrical tube having a top flange and its bottom end adapted to receive a drill bit, said top flange connected to said bottom flange of said drive string tube, expandable support means carried by said drill bit drive tube adapted to expand radially outward therefrom to be received within said casing or conductor pipe on said support shoulder, shock absorbing means interposed between said drill bit drive tube and said expandable support means for reducing the percussive force transmitted therebetween by said driving means, a fluid driven down hole motor interposed between said drill bit drive tube and said drill bit for imparting rotary motion to said drill bit.

11. The apparatus according to claim 6, 9, or 10, wherein said shock absorbing means comprises an elongated inner tubular member provided with a flange at its upper end and a shorter concentric outer cylindrical member joined at its upper end to said inner member, said outer member of larger diameter than said inner member to form a cylindrical cavity therebetween, a cylindrical thrust spool member slidably received on said inner member, said spool having a thin cylindrical vertical upper portion which is telescopically received with said cavity, an intermediate portion of larger diameter than said upper portion to define an upper annular shoulder therebetween, a bottom portion of larger diameter than said intermediate portion to define a lower annular shoulder therebetween, a thin cylindrical cup shaped outer housing having a bottom portion slidably received on the vertical upper portion of said spool member and supported on said upper shoulder, the inner surface of the cylindrical wall of said outer housing slidably received on the circumference of outer member and the bottom portion spaced downwardly from the bottom surface thereof to form an enclosed cylindrical cavity around the vertical upper portion of said spool member, and several layers or rings of shock absorbing material disposed within said cavity to absorb percusive force transmitted thereto by vertical movement of said spool.

12. The apparatus according to claim 6, 9, or 10, wherein said expandable support means comprises;

a cylindrical lock-in stabilizer spool slidably received on the circumference of the drill bit drive tube and journaled therebetween for rotary movement relative thereto, said spool having a cylindrical upper portion, an intermediate portion provided with circumferentially disposed longitudinal radially opposed slots, and a cylindrical bottom portion, each said slot defining at each end thereof an upper shoulder and a lower shoulder therebetween, a cylindrical outer upper retaining cap member secured to said upper portion, the lower end positioned slightly below said upper shoulder of said slots, a cylindrical outer lower retaining cap member secured to said bottom portion, the upper end positioned slightly below said lower shoulder of said slots, a series of circumferentially spaced apart radially opposed lock-in blades slidably disposed within said slots vertically around the circumference of said intermediate portion of said spool between said upper and lower shoulders of said slots, said blades spring biased outwardly from the inner surface of said slots to ride on said shoulders and their upper and lower portions captured by the inner surface of the upper and lower cap members which extend above and below said shoulders of said slots, said blades provided with a short straight vertical surface on their outer periphery having a shoulder receiving notch therein to receive and be supported by a mating support shoulder disposed within said casing or conductor pipe.

13. The apparatus according to claim 6, 9, or 10, wherein said expandable support means comprises;

a concentric cylindrical ring member slidably disposed on the circumference of said drill bit drive tube, a plurality of radially expanding members having their upper ends pivotally connected to said ring member and their lower ends adapted to expand radially outward therefrom to be received within said support shoulder, and wherein said shock absorbing means comprises;

a compression spring disposed on the circumfernce of said drill string and biased between the top surface of said sliding ring and the bottom surface of the top flange of said drill bit drive tube.

14. The apparatus according to claim 6, 9, or 10 wherein said latch assembly comprises;

an elongated longitudinal hollow cylindrical latch drive tube having a top flange and a cylindrical bottom flange spaced downwardly therefrom, a cylindrical latch dog member having a cylindrical upper portion secured to said latch drive tube below said top flange and a hollow slotted expandable bottom portion extending downwardly therefrom forming a series of expandable fingers or collets having a recess therein and a tapered surface above said recess, said recess adapted to receive and capture said bottom flange and said flange of said drive string assembly, said upper portion provided with a pressure inlet bore extending from its exterior surface to its bottom surface and having a pressure connection secured therein for receiving fluid pressure from a source, said bottom flange provided with a pressure relief bore from its top surface in communication with atmosphere, a downwardly extending pin member to be received within a bolt hole of the top flange of said drill string assembly, and a tubular guide tube member adapted to be received within the top flange of said drill string assembly, a cylindrical latch piston slidably received on the circumference of said latch drive tube intermediate said top flange and said bottom flange and within the inner diameter of said collets, said piston provided with a counterbore extended upwardly a distance from the bottom surface thereof a compression spring having one end received within said counterbore and the other end biased on the top surface of said bottom flange to urge said piston upwardly therefrom, said piston to travel downward upon receiving fluid pressure applied through said inlet bore to contact and travel down on said tapered surface to expand said collets and release their grip on said bottom flange and said top flange of said drill string assembly to connect or disconnect sections of drill string below said latch assembly.

15. The method of driving casing or conductor pipe into the ground comprising the following steps;

attaching a reciprocating percussion hammer and impact block to the top of a section of casing or conductor pipe and driving the casing or conductor pipe into the ground until it stops, said casing or conductor pipe provided with an internal support means within its lower portion, removing the hammer from the top of the casing or conductor pipe, lowering into the casing or conductor pipe an apparatus having an upper housing, a drill string assembly, a drill bit connected to said drill string assembly, and a fluid driven drilling means connected thereto for imparting rotary motion to said bit, means for creating a fluid pressure differential between the interior and the exterior of said drill string to evacuate drilling debris and cuttings from the drilled hole, shock absorbing means, and expandable support means, connecting the upper housing of said apparatus to the top of said casing or conductor pipe, further lowering the apparatus within the casing or conductor pipe until the expandable support members are received on the support shoulder of the casing or conductor pipe, further lowering the apparatus within the casing or conductor pipe until the drill bit comes to rest on the soil at the bottom of the casing or conductor pipe, placing said hammer and impact block at the top portion of said upper housing, actuating the fluid driven drilling means and the hammer to begin rotary drilling and reciprical hamering actions, creating a hydrostatic head by pumping water into the area between the outer surface of the drill string and the inner surface of the conductor pipe, creating a pressure differential between the interior of the drill string and the hydrostatic head by introducing air under pressure into the drill string portion, establishing circulation to the top of said apparatus to effectively evacuate drilling debris and cuttings from the drilled hole and eject them through outlets at the upper housing, coordinating drilling speed with driving action so that as the soil plug moves up in the conductor pipe, drilling speed may be increased to get the drill bit back down to the bottom portion of the casing or conductor pipe.

16. The method of driving casing or conductor pipe into the ground comprising the following steps;

attaching a reciprocating percussion hammer and impact block to the top of a section of casing or conductor pipe and driving the casing or conductor pipe into the ground until it stops, said casing or conductor pipe provided with an internal support means within its lower portion, removing the hammer from the top of the casing or conductor pipe, lowering into the casing or conductor pipe an apparatus having an upper housing, a drill string assembly, a drill bit connected to said drill string assembly, and a fluid driven drilling means connected thereto for imparting rotary motion to said bit, means for creating a fluid pressure differential between the interior and the exterior of said drill string to evacuate drilling debris and cuttings from the drilled hole, shock absorbing means, and expandable support means, connecting the upper housing of said apparatus to the top of said casing or conductor pipe, further lowering the apparatus within the casing or conductor pipe until the expandable support members are received on the support shoulder of the casing or conductor pipe, further lowering the apparatus within the casing or conductor pipe until the drill bit comes to rest on the soil at the bottom of the casing or conductor pipe, placing said hammer and impack block at the top portion of said upper housing, actuating the fluid driven drilling means and the hammer to begin rotary drilling and reciprical hamering actions, creating a hydrostatic head by pumping water into the drill string, creating a pressure differential between the interior of the drill string and the hydrostatic head by removing water from the area between the outer surface of the drill string and the inner surface of the casing or conductor pipe, establishing circulation to the top of said apparatus to effectively evacuate drilling debris and cuttings from the drilled hole and eject them through outlets at the upper housing, coordinating drilling speed with driving action so that as the soil plug moves up in the conductor pipe, drilling speed may be increased to get the drill bit back down to the bottom portion of the casing or conductor pipe.

17. The method of driving casing or conductor pipe into the ground comprising the following steps;

attaching a reciprocating percussion hammer and impact block to the top of a section of casing or conductor pipe and driving the casing or conductor pipe into the ground until it stops, said casing or conductor pipe provided with an internal support means within its lower portion, removing the hammer from the top of the casing or conductor pipe, lowering into the casing or conductor pipe an apparatus having an upper housing, a drill string assembly, a drill bit connected to said drill string assembly, and a fluid driven down hole motor connected thereto for imparting rotary motion to said bit, means for creating a fluid pressure differential between the interior and the exterior of said drill string to evacuate drilling debris and cuttings from the drilled hole, shock absorbing means, and expandable support means, connecting the upper housing of said apparatus to the top of said casing or conductor pipe, further lowering the apparatus within the casing or conductor pipe until the expandable support members are received on the support shoulder of the casing or conductor pipe, further lowering the apparatus within the casing or conductor pipe until the drill bit comes to rest on the soil at the bottom of the casing or conductor pipe, placing said hammer and impact block at the top portion of said upper housing, actuating the fluid driven down hole motor and the hammer to begin rotary drilling and reciprical hamering actions, creating a hydrostatic head by pumping water into the drill string, creating a pressure differential between the interior of the drill string and the hydrostatic head by removing water from the area between the outer surface of the drill string and the inner surface of the casing or conductor pipe, establishing circulation to the top of said apparatus to effectively evacuate drilling debris and cuttings from the drilled hole and eject them through outlets at the upper housing, coordinating drilling speed with driving action so that as the soil plug moves up in the conductor pipe, drilling speed may be increased to get the drill bit back down to the bottom portion of the casing or conductor pipe.

* * * * *